United States Patent [19]

Byerly et al.

[11] Patent Number: 4,643,688

[45] Date of Patent: Feb. 17, 1987

[54] METHOD FOR ASSEMBLING A SPARK PLUG

[75] Inventors: Dale L. Byerly, Toledo; Richard L. Black, Perrysburg; Richard S. Podiak, Maumee, all of Ohio

[73] Assignee: Champion Spark Plug Company, Toledo, Ohio

[21] Appl. No.: 667,193

[22] Filed: Nov. 1, 1984

[51] Int. Cl.[4] ..... H01T 21/02

[52] U.S. Cl. ..... 445/3; 445/7; 33/169 B

[58] Field of Search ..... 445/3, 7; 29/407, 445; 33/169 B

[56] References Cited

U.S. PATENT DOCUMENTS

| | | | |
|---|---|---|---|
| 2,139,793 | 12/1938 | Benton | 445/7 X |
| 2,487,531 | 11/1949 | Dutterer | 445/7 X |
| 2,503,194 | 4/1950 | Cipiani | 445/7 X |
| 2,899,634 | 4/1959 | Carbonneau | 445/3 X |
| 2,959,703 | 11/1960 | Hastings | 445/7 X |
| 3,289,446 | 12/1966 | Davey | 29/407 X |
| 4,216,585 | 8/1980 | Hatter | 33/169 B |

*Primary Examiner*—Kenneth J. Ramsey

*Attorney, Agent, or Firm*—Oliver E. Todd, Jr.

[57] ABSTRACT

A method for assembling a spark plug 20, 66 which includes providing a ground electrode 24 on a spark plug shell 22 having a predetermined final configuration and position and then mounting an insulator 34 in the shell. The distance from a step 38 in an insulator bore 37 to the ground electrode is measured. Based upon this measurement and a desired dimension for a spark gap 56, the dimension on a center electrode 48, 68, 74 between a shoulder 50, 76 and a tip 52, 80 is adjusted so that when the center electrode is disposed in the insulator bore with the shoulder seated on the bore step, the tip forms the desired spark gap with the ground electrode. The center electrode then is assembled into the insulator.

5 Claims, 10 Drawing Figures

METHOD FOR ASSEMBLING A SPARK PLUG

TECHNICAL FIELD

This invention relates to spark plug manufacturing and more particularly to an improved method for assembling a spark plug of the type having a shell with an attached ground electrode, an insulator mounted in the shell and a center electrode assembly mounted in a stepped bore through the insulator.

BACKGROUND ART

In the conventional methods used for manufacturing spark plugs, a center electrode assembly is mounted in an insulator bore and a ground electrode is welded to a shell prior to mounting the insulator in the shell. The insulator has a stepped bore in which the center electrode assembly is mounted. The center electrode assembly includes a center electrode having an enlarged diameter head or shoulder which is seated on the insulator bore step and a tip which projects from an insulator firing tip or nose for forming a spark gap with the ground electrode on the shell. The center electrode may include an extendion above the shoulder. A powdered sealing material, such as talc, is tamped in the annular space between the wire, the center electrode shoulder and the insulator to retain the center electrode and to form a seal. In one conventional type of spark plug, a terminal is threaded and cemented into the upper end of the insulator bore in contact with the center electrode wire to complete the center electrode assembly. In another type of spark plug, a spring and a resistor or an ignition noise suppression element are positioned in the insulator bore and a terminal is threaded and cemented into the upper bore end to complete the center electrode assembly. In that situation the spring is compressed to maintain series electrical continuity between the terminal, the resistor and the center electrode wire. In still another type of spark plug, an electrically conductive or semi-conductive powder is tamped under high pressure in the insulator bore above the head or shoulder on the center electrode. The tamped powder retains the center electrode, forms a seal and maintains electrical continuity in the center electrode assembly. When the tamped material has semi-conducting properties, it also may function as an ignition noise suppressor. A spring is inserted into the insulator bore and a terminal is threaded and cemented into the upper end of the bore to complete the center electrode assembly. Again, the spring maintains series electrical continuity between the terminal and the tamped powder.

Various methods are used for assembling a spark plug insulator and shell. In one common assembly method, a gasket is positioned on an internal shoulder or step in the shell. The insulator then is positioned in the shell so that a shoulder or flange on the insulator seats on the gasket. A powder sealing material is tamped under high pressure into the annular space between the insulator, the insulator shoulder and the shell to firmly hold the insulator in place and to form a seal. Finally, the upper edge of the shell is rolled inwardly to retain the powder.

In a modified method for assemblying the insulator and the shell known as the "hot press" method, the insulator is placed in the shell with a radially extending flange or shoulder seated on a step or shoulder in the shell. A gasket then may be positioned on top of the insulator flange and the upper edge of the shell is rolled inwardly to retain the insulator in the shell. A high electric current is passed longitudinally through the shell to heat a thin walled section. Or, the thin walled shell section may be inductively heated. While the thin walled section is hot, the shell is pressed and axially collapsed at the thin walled section. The pressure is maintained while the shell cools. During this process, the shell shoulder and/or gasket is deformed slightly by the insulator shoulder to form a seal between the shell and the insulator.

In a "cold press" method of assemblying a spark plug insulator in a shell, the insulator is positioned in the shell with a radial flange or shoulder on the insulator seated on a shell shoulder, or on a gasket which is positioned on the shell shoulder, and a powdered sealing material is tamped in the annular space above the insulator flange between the insulator and the shell. The upper end of the shell then is rolled inwardly over the upper end of the tamped powder and the shell is axially collapsed at a thin walled section by applying a high axial pressure to the shell. The pressure slightly deforms the shell shoulder or the gasket to form a seal between the insulator and the shell. The compressed resilient powder above the insulator shoulder holds the insulator shoulder firmly against the shell shoulder and also forms a seal.

When the insulator and shell are assembled by any of the above methods, a tip of the center electrode assembly projects from the insulator for forming one side of a spark gap. Because of normal manufacturing tolerance variations in manufacturing the center electrode, the insulator and the shell and in assemblying these components, there may be considerable variation in the location of the center electrode tip projecting from the insulator. The tolerance variations are corrected by trimming the center electrode tip. After the tip is trimmed, the ground electrode is bent to a final configuration to form a desired spark gap with the center electrode. The tolerance variations which require trimming the center electrode add to the cost of manufacturing the spark plug. Also, trimming the center electrode tip after the center electrode is assembled in the insulator and bending the ground electrode after the insulator assembly is mounted in the shell may place undesirable stresses on the insulator.

DISCLOSURE OF THE INVENTION

This invention relates to an improved method of assemblying spark plugs which eliminates the effects of tolerance variations in the shell, the insulator and the center electrode and in their assembly and reduces sources of stress on the insulator during assembly of the spark plug. A ground electrode is attached to a standard shell and is bent to a predetermined final configuration and position. An insulator having a stepped bore then is mounted in the shell by any conventional method so that the bore is aligned with a spark gap surface on the ground electrode. A probe is inserted into the insulator bore to measure the distance between the bore step and the spark gap surface on the ground electrode. The measured distance is supplied to a controller for a mill or grinder or shear, for example, which adjusts the spark gap tip of a center electrode. The tip is adjusted so that the dimension from the tip to a shoulder on the center electrode is equal to the measured insulator bore step to ground electrode distance less a desired spark gap dimension. Or, the center electrode shoulder may be in the form of an enlarged diameter ring which frictionally engages the center electrode. In this case, the controller controls repositioning of the shoulder on the center electrode to give the desired shoulder to tip dimension. The center electrode then is positioned in the insulator bore with the shoulder seated on the insulator bore step and the center electrode assembly is completed in a conventional manner.

Accordingly, it is a principal object of the invention to provide an improved method of assembling spark plugs.

The above and other objects, features and advantages of the invention will become apparent upon consideration of the following detailed description and the appended drawings.

BEST MODES FOR CARRYING OUT INVENTION

Figure 1:
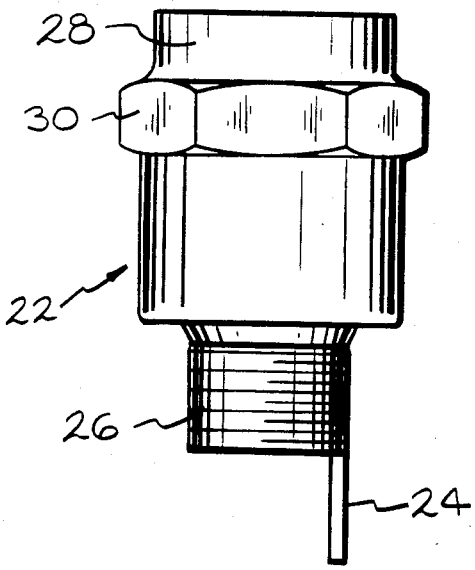
FIG. 1 is a vertical side view of a spark plug shell with an attached but unbent ground electrode.
Figure 2:
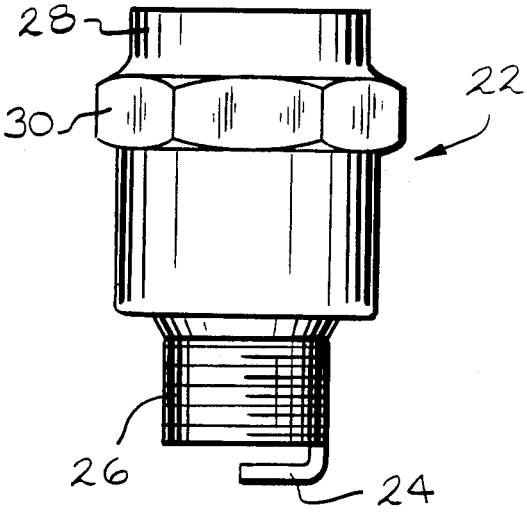
FIG. 2 is a vertical side view of the spark plug shell of FIG. 1, but with the ground electrode bent to a predetermined final configuration and position.

Referring to FIGS. 1 through 7, an improved method of assembling a resistor type spark plug 20 (FIG. 7) is illustrated. Initially, a conventional tubular spark plug shell 22 is formed and a straight ground electrode 24 is attached, as illustrated in FIG. 1. The shell has an externally threaded lower end 26 which engages an engine (not shown), an upper sleeve end 28 and an intermediate hexagonal section 30. The ground electrode 24 is bent to a predetermined final configuration and position, as shown in FIG. 2.

Figure 3:
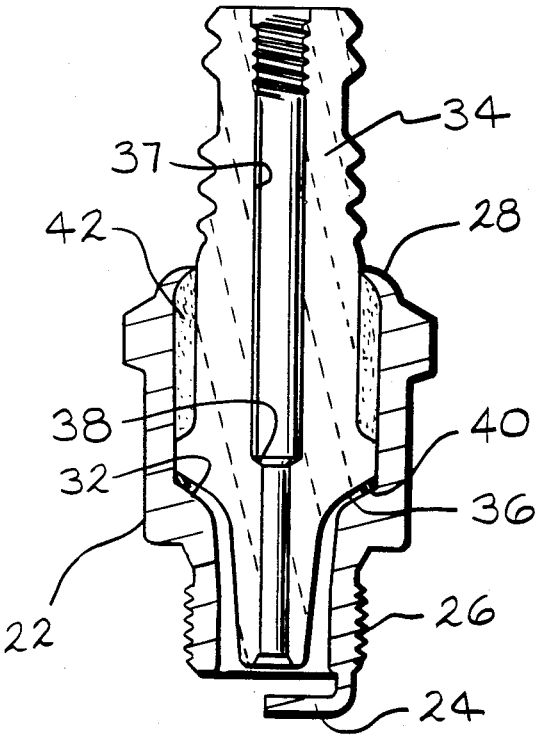
FIG. 3 is a vertical cross sectional view of the spark plug shell of FIG. 2, but with an insulator mounted in the shell.

After bending the ground electrode 24, a gasket 40 is positioned on internal shoulder 32 in the shell and a conventional tubular spark plug insulator 34 is inserted into the shell 22, as illustrated in FIG. 3. The insulator 34 has a radially extending shoulder 36 and an axial bore 37 having a step 38. The insulator is inserted into the shell 22 so that the insulator shoulder 36 is seated on the gasket 49 and the stepped bore 37 is aligned with the ground electrode 24. In some spark plug designs, the gasket 40 is omitted and the insulator shoulder 36 is seated directly on the shell shoulder 32. The insulator 34 is fastened in the shell 22 by tamping under high pressure a suitable powder 42, such as talc or a mixture including talc, into the annular space above the insulator shoulder 36 and between the insulator 34 and the shell 22. After tamping, the shell sleeve end 28 is rolled inwardly over the powder 42 to retain the powder 42. The compressed powder 42 forms a seal between the shell 22 and the insulator 34 and resiliently holds the insulator shoulder 36 against the shell shoulder 32.

The next step of the spark plug assembly method involves measuring the linear distance between the insulator bore step 38 and the spark gap side of the previously bent ground electrode 24. A probe 43 including a sleeve 44 and a rod 45 which telescops within the sleeve 44 is inserted into the insulator bore 37 until the sleeve 44 contacts the insulator bore step 38. The rod 45 is extended through the insulator until it contacts the spark gap side of the ground electrode 24. The sleeve 44 and the rod 45 are connected to a measuring device, such as a linear potentiometer (not shown) which electrically measures the distance the rod 45 extends past the end of the sleeve 45 at the insulator bore step 38. Thus, a signal is established by the probe 43 indicative of the linear distance between the insulator bore step 38 and the ground electrode 24.

The signal from the probe 43 is transmitted to a controller (not shown) for an automatic mill to position a cutting tool 46 (FIG. 5), such as a mill or a shear or a grinder. The cutting tool 46 is positioned to trim off a tip 52 of a center electrode 48 having a shoulder 50 located intermediate the tip 52 and an upper electrode end 54. The center electrode 48 is trimmed to provide a predetermined dimension between the shoulder 50 and the tip 52 based upon the measurement by the probe 43 and a desired spark gap size. The mill controller calculates the center electrode shoulder 50 to tip 52 dimension by subtracting the desired spark gap dimension from the measured insulator step 38 to ground electrode 24 dimension and uses this calculated data for positioning the tool 46 relative to the electrode shoulder 50 during the trimming operation.

Figure 6:
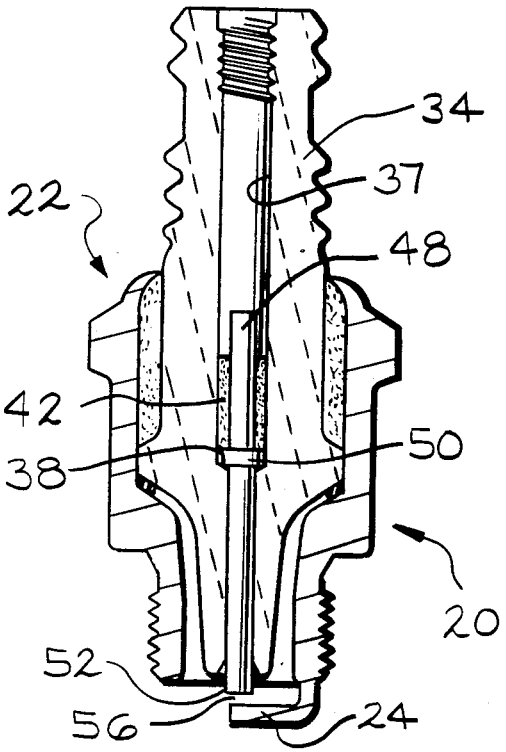
FIG. 6 is a vertical cross sectional view showing the trimmed center electrode inserted and fastened in the preassembled insulator and shell assembly.

After trimming, the center electrode 48 is inserted into the insulator bore 37 so that the electrode shoulder 50 is seated on the bore step 38, as illustrated in FIG. 6. The electrode tip 52 projects from the insulator 34 adjacent the ground electrode 24 and defines a spark gap 56 having the desired dimension without further trimming. Thus, tolerance variations in the center electrode 48, the insulator 34 and the shell 22 and in assembling the insulator 34 in the shell 22 are compensated for without the need for trimming the center electrode 48 after mounting in the insulator 34. This reduces the cost in manufacturing the spark plug 20 and eliminates common sources of stress placed on the insulator during manufacture of a spark plug.

The center electrode 48 is fastened in the insulator bore 37 by tamping a powder 42 into the annular space above the electrode shoulder 50 between the center electrode 48 and the insulator 34. The powder 42 not only retains the center electrode 48, but also forms a seal between the center electrode 48 and the insulator 34.

Figure 7:
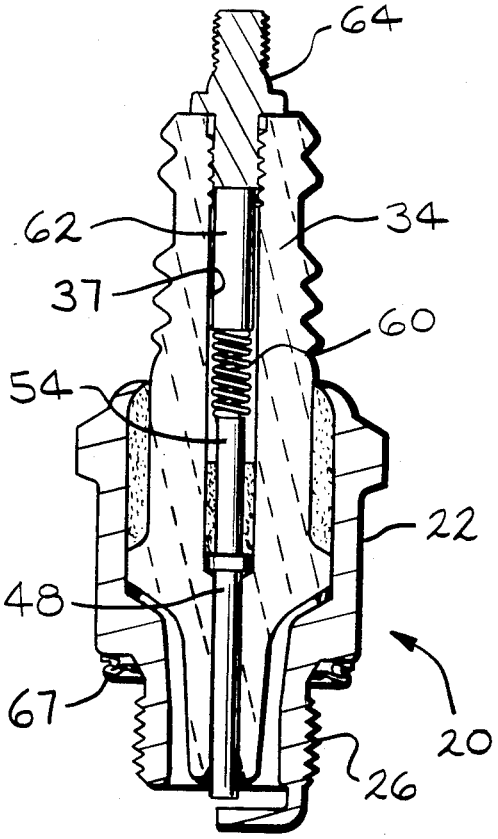
FIG. 7 is a vertical cross sectional view of a completed resistor type spark plug.

After the center electrode 48 is fastened in the insulator bore 37, the center electrode assembly is completed, as illustrated in FIG. 7. Since the exemplary spark plug 20 is of a resistor type, a spring 60 and a resistor element 62 and inserted in series in the insulator bore above the center electrode end 54. FIG. 7 shows the spring 60 positioned below the resistor element 62. However, it will be appreciated that the spring 60 may be positioned above the resistor element 62. Finally, a terminal 64 is threaded and cemented into the insulator bore 37 and, when needed, a gasket 67 is positioned over the threaded shell end 26 to complete assembly of the spark plug 20. When the terminal is attached to the insulator 34, the spring 62 is compressed to maintain electrical continuity in the center electrode assembly.

Figure 4:
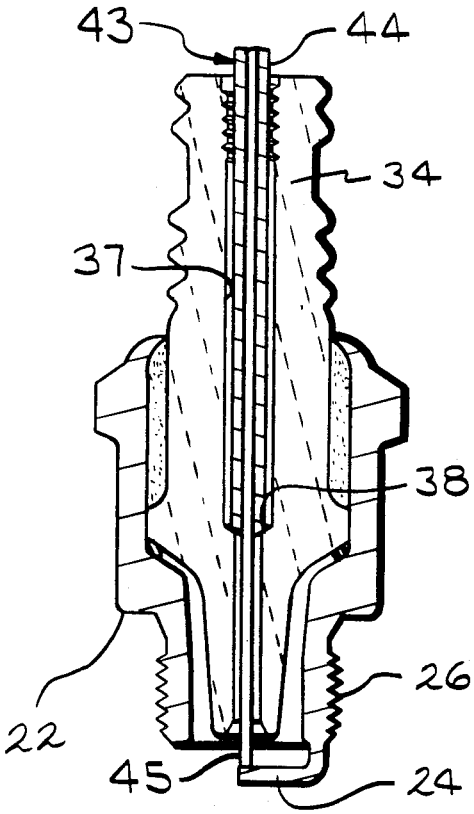
FIG. 4 is a vertical cross sectional view of the spark plug shell and insulator assembly of FIG. 3 and showing a fragmentary portion of a probe measuring the distance from an internal step in an insulator bore to the ground electrode.
Figure 5:
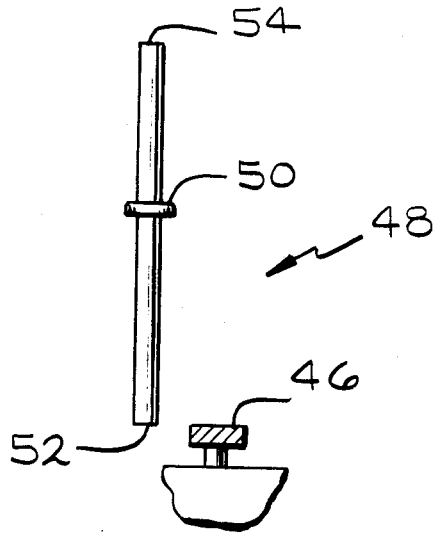
FIG. 5 is a side elevational view illustrating the step of trimming the tip of the center electrode.
Figure 8:
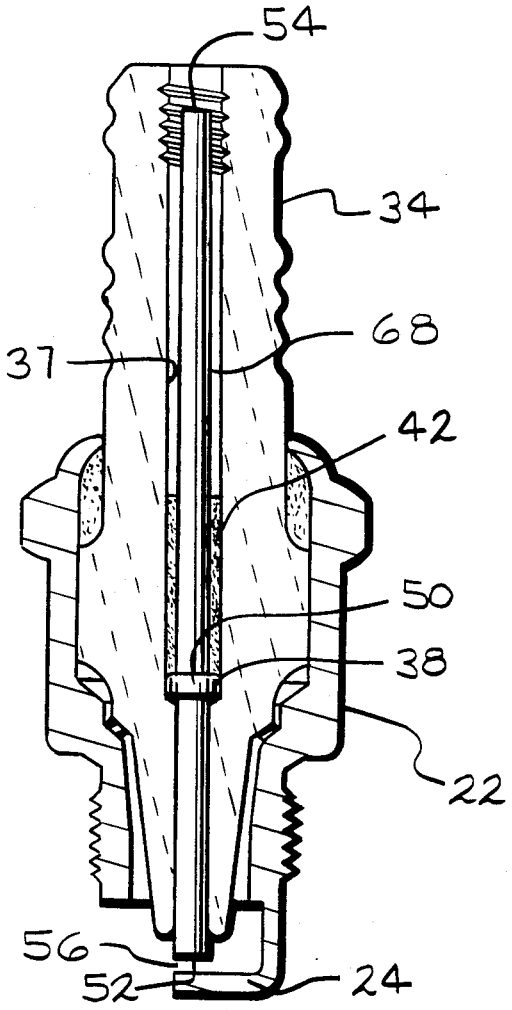
FIG. 8 is a vertical cross sectional view of a modified trimmed center electrode inserted and fastened in the preassembled insulator and shell assembly.
Figure 9:
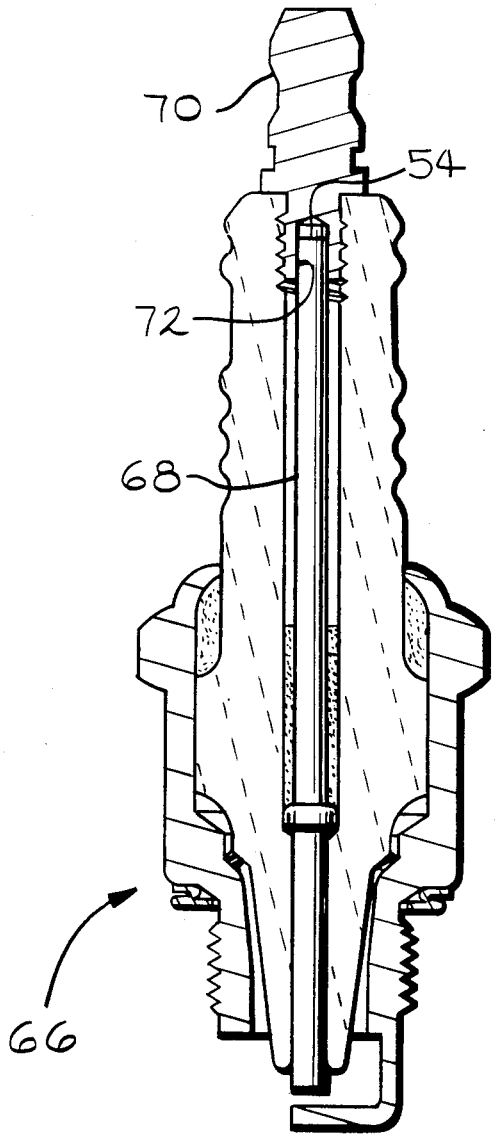
FIG. 9 is a vertical cross sectional view of a completed non-resistor type spark plug.

The spark plug assembly method is equally applicable to the manufacture of a conventional non-resistor type spark plug 66, as shown in FIG. 9. The initial steps of the method are the same as those shown in FIGS. 1 through 5 for the spark plug 20. The only difference is that the spark plug 66 has a center electrode 68 which is longer than the center electrode 48 to compensate for the eliminated spring 60 and resistor element 62. The insulator 34 is mounted in the shell 22 having the attached and preformed ground electrode 24, as illustrated in FIGS. 1 through 3, and the linear distance between the insulator bore step 38 and the ground electrode 24 is measured, as illustrated in FIG. 4. Next, the center electrode 68 is trimmed to provide a dimension between the electrode shoulder 50 and the electrode tip 52 to produce a desired spark gap 56 when the center electrode 68 is assembled into the insulator 34, as shown in FIG. 8.

After the center electrode 68 is trimmed, it is positioned in the insulator bore 37 with the shoulder 50 seated on the insulator bore step 38 and powder 42 is tamped under high pressure in the annular space above the center electrode shoulder 50 between the center electrode 68 and the insulator 34. The powder 42 retains the center electrode 68 in the insulator bore 37 and forms a seal between the insulator 34 and the center electrode 68. After tamping the powder 42, a terminal 70 is threaded and cemented in the insulator bore 37. The terminal 70 has a bore 72 which telescopically receives and makes electrical contact with the upper end 54 of the center electrode 68.

Figure 10:
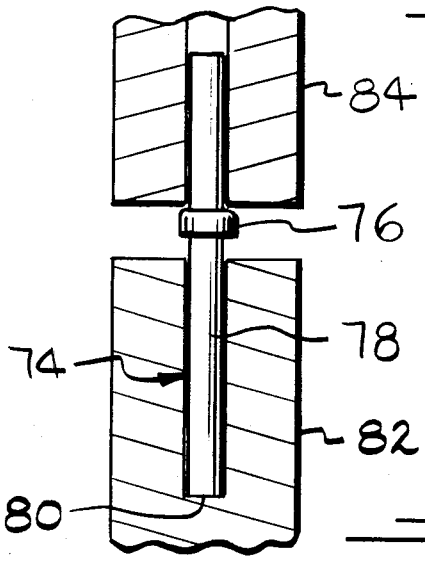
FIG. 10 is a fragmentary cross sectional side view illustrating dies adjusting the dimensions of a center electrode by repositioning a shoulder on the center electrode.

Normally, center electrodes such as the center electrodes 48 and 68 are formed with the shoulder 50 and the portion below the shoulder 50 having at least surfaces of a corrosion resistant metal such as nickel or a nickel alloy. The upper portion of the center electrode above the shoulder 50 is of a low cost metal, such as an iron wire, and is welded or otherwise attached to the top of the shoulder 50. In a modified design for a center electrode 74 (FIG. 10), a shoulder 76 is in the form of a ring which frictionally engages a central shaft 78 of the electrode. With an electrode 74 of this design, it is unnecessary to trim an electrode tip 80 to adjust the shoulder 76 to tip 80 dimension. The electrode 74 is simply placed in a blind die 82 and a tool 84 is moved downwardly into contact with the shoulder 76. The tool is advanced further to push the shoulder 76 down the electrode shaft 78 until a desired shoulder 76 to tip 80 dimension is achieved for producing a desired spark gap when the center electrode 74 is mounted in a particular assembled insulator and shell.

The above described methods for assemblying a spark plug also are applicable to a spark plug in which the center electrode shoulder is located at the end of the center electrode. In this case, the center electrode is trimmed to length to give a desired spark gap when mounted in a particular assembled insulator and shell. The trimmed electrode is inserted into the insulator bore with the shoulder seated on a bore step and an electrically conductive or semi-conductive powder is tamped at a high pressure in the bore above the center electrode shoulder to form a seal and to retain the electrode. When the powder is a semi-conductor, a predetermined quantity may be tamped into the insulator bore to provide desired ignition noise suppression properties. A spring is added above the tamped powder and a terminal is threaded and cemented in the end of the insulator bore.

It will be appreciated that various known methods may be used for mounting the spark plug insulator in the shell and for mounting the center electrode in the insulator. It will be understood that various modifications, other than those described, can be made to the invention without departing from the spirit and scope of it, and so the limits of the invention should be determined from the claims when construed in light of the prior art.

We claim:

1. A method for assembling a spark plug including a shell, an insulator mounted in said shell and a center electrode mounted in a stepped bore through said insulator comprising the steps of:

providing a ground electrode on said shell having a predetermined final configuration and position;

mounting said insulator in said shell with said stepped bore aligned with said ground electrode;

measuring the distance from said insulator bore step to said ground electrode;

adjusting the distance between a shoulder and a spark tip on said center electrode in response to the measured insulator bore step to ground electrode distance to produce a desired spark gap dimension between said tip and said ground electrode when said center electrode is mounted in said insulator bore with said shoulder seated on said step; and mounting said center electrode in said insulator bore with said shoulder seated on said insulator bore step.

2. A method for assemblying a spark plug, as set forth in claim 1, wherein said adjusting step comprises trimming off a portion of said center electrode tip.

3. A method for assemblying a spark plug, as set forth in claim 1, wherein said adjusting step comprises moving said shoulder on said center electrode relative to said center electrode tip.

4. A method for assemblying a spark plug, as set forth in claim 1, wherein said step of mounting said center electrode in said insulator bore includes the steps of positioning said center electrode in said insulator bore with said shoulder seated on said insulator bore step, and tamping a powder between said center electrode and said insulator to retain said center electrode and to form a seal.

5. A method for assembling a spark plug including a shell, an insulator mounted in said shell and a center electrode assembly mounted in a stepped bore through said insulator comprising the steps of:

providing a ground electrode on said shell having a predetermined final configuration and position;

mounting said insulator in said shell with said stepped bore aligned with said ground electrode;

measuring the distance from said insulator bore step to said ground electrode;

trimming a center electrode to a predetermined dimension between a shoulder and a tip on said center electrode, based upon said measured distance, to provide a desired spark gap between said center electrode tip and said ground electrode when said center electrode is disposed in said insulator bore with said shoulder seated on said step;

positioning said center electrode into said insulator bore with said shoulder seated on said step and said tip defining said desired spark gap with said ground electrode;

tamping a powder in said bore between said insulator and said center electrode to form a seal and to retain said center electrode in said insulator; and completing said center electrode assembly.

* * * * *